US008974197B2

(12) United States Patent
VanBritson et al.

(10) Patent No.: US 8,974,197 B2
(45) Date of Patent: Mar. 10, 2015

(54) COMPACT STRUCTURE FOR AN ELECTRIC COMPRESSOR

(75) Inventors: Timothy Raymond VanBritson, Livonia, MI (US); Michael Gregory Theodore, Jr., Plymouth, MI (US); Kanwal Bhatia, Canton, MI (US); Scott Wenzel, Canton, MI (US); Brian Robert Kelm, Plymouth, MI (US)

(73) Assignee: Halla Visteon Climate Control Corporation, Daejeon-si (KR)

( * ) Notice: Subject to any disclaimer, the term of this patent is extended or adjusted under 35 U.S.C. 154(b) by 395 days.

(21) Appl. No.: 12/706,404

(22) Filed: Feb. 16, 2010

(65) Prior Publication Data

US 2011/0200466 A1 Aug. 18, 2011

(51) Int. Cl.

| | |
|---|---|
| ***F04D 29/40*** | (2006.01) |
| ***F04C 18/02*** | (2006.01) |
| ***F01C 21/02*** | (2006.01) |
| ***F01C 21/10*** | (2006.01) |
| ***F04C 29/06*** | (2006.01) |
| *F04C 29/00* | (2006.01) |

(52) U.S. Cl.

CPC ..... *F04C 18/0215* (2013.01); *F01C 21/02* (2013.01); *F01C 21/10* (2013.01); *F04C 29/06* (2013.01); *F04C 29/0042* (2013.01); *F04C 2230/602* (2013.01); *F04C 2230/603* (2013.01); *F04C 2240/30* (2013.01); *F04C 2270/12* (2013.01)

USPC ..... 417/423.14; 417/410.5; 417/424.1; 417/410.3; 417/423.1; 417/423.12; 418/55.1; 418/55.4

(58) Field of Classification Search

CPC ..... F04C 2/025

USPC ..... 417/410.5, 423.14, 424.1, 410.3, 423.1, 417/423.12; 418/55.1, 55.4

See application file for complete search history.

(56) References Cited

U.S. PATENT DOCUMENTS

| | | | | |
|---|---|---|---|---|
| 2,885,962 | A | 5/1959 | Campbell | |
| 2,965,038 | A | 12/1960 | Purden et al. | |
| 4,201,521 | A | 5/1980 | Carlson | |
| 4,527,964 | A | 7/1985 | Mitsui et al. | |
| 4,900,238 | A | 2/1990 | Shigemi et al. | |
| 5,098,265 | A | 3/1992 | Machida et al. | |
| 5,247,738 | A | 9/1993 | Yoshii | |
| 5,312,234 | A | 5/1994 | Yoshii | |
| 5,354,182 | A | 10/1994 | Niemiec et al. | |
| 5,374,166 | A | 12/1994 | Fukui | |
| 5,399,075 | A | 3/1995 | Frank et al. | |
| 5,443,374 | A | 8/1995 | Yoshii et al. | |
| 5,634,781 | A * | 6/1997 | Yoshida et al. | 418/55.1 |

(Continued)

FOREIGN PATENT DOCUMENTS

| | | |
|---|---|---|
| EP | 1679441 A1 | 7/2006 |
| EP | 1336760 B1 | 4/2007 |

(Continued)

*Primary Examiner* — Christopher Bobish

(74) *Attorney, Agent, or Firm* — Dickinson Wright PLLC

(57) ABSTRACT

The invention relates to a system and method of providing a compressor mechanism having a front housing, center housing and rear housing. The center housing includes an integrated compressor bearing support and compressor base surface that divides the housing into cantilevered wall sections. The system and method constructed in this manner provides a compact structure for an electric compressor with the ability to reduce noise vibration harshness.

4 Claims, 5 Drawing Sheets

(56) References Cited

U.S. PATENT DOCUMENTS

| | | | | |
|---|---|---|---|---|
| 5,639,228 | A * | 6/1997 | Van De Venne et al. | 417/423.14 |
| 5,649,817 | A | 7/1997 | Yamazaki | |
| 5,747,905 | A | 5/1998 | Yabushita et al. | |
| 5,823,753 | A * | 10/1998 | Kemmerling | 417/423.14 |
| 6,027,317 | A * | 2/2000 | Barthod et al. | 417/410.5 |
| 6,082,974 | A * | 7/2000 | Takemoto et al. | 417/366 |
| 6,129,176 | A | 10/2000 | Hunsberger et al. | |
| 6,254,360 | B1 * | 7/2001 | Sato | 417/366 |
| 6,281,607 | B1 | 8/2001 | Petach et al. | |
| 6,465,927 | B2 | 10/2002 | Shiraki et al. | |
| 6,503,069 | B2 | 1/2003 | Moroi et al. | |
| 6,511,295 | B2 | 1/2003 | Suitou et al. | |
| 6,568,928 | B2 | 5/2003 | Gennami et al. | |
| 6,626,652 | B2 * | 9/2003 | Koyama et al. | 417/423.1 |
| 6,687,992 | B2 | 2/2004 | Quesada et al. | |
| 6,695,599 | B2 | 2/2004 | Uchida et al. | |
| 6,749,404 | B2 | 6/2004 | Gennami et al. | |
| 6,832,901 | B2 * | 12/2004 | Kuehn et al. | 417/423.1 |
| 7,195,470 | B2 | 3/2007 | Kimura et al. | |
| 7,717,687 | B2 * | 5/2010 | Reinhart | 418/55.5 |
| 8,113,800 | B2 * | 2/2012 | Koitabashi et al. | |
| 2007/0182259 | A1 | 8/2007 | Sakata et al. | |
| 2009/0123310 | A1 * | 5/2009 | Kim et al. | 417/423.1 |
| 2009/0155101 | A1 * | 6/2009 | Fukasaku et al. | 417/410.1 |

FOREIGN PATENT DOCUMENTS

| | | | |
|---|---|---|---|
| EP | 2072754 | A2 | 6/2009 |
| EP | 2072821 | A2 | 6/2009 |
| EP | 2072822 | A2 | 6/2009 |
| EP | 2075470 | A2 | 7/2009 |

* cited by examiner

COMPACT STRUCTURE FOR AN ELECTRIC COMPRESSOR

BACKGROUND OF THE INVENTION

1. Technical Field

The invention relates to a compact structure for an electric compressor, and in particular, to a compact structure for an electric compressor that reduces noise vibration harshness.

2. Discussion

With an increasing need to reduce fuel usage and emissions, companies are constantly pursuing alternative fuel and energy sources. Such pursuit of alternative fuels and energy has resulted in vehicles using either partially or entirely electric motors. For example, increasing numbers of automobiles are being developed as fuel/electric hybrids, plug in hybrids or total electric vehicles. With the electrification of these vehicles, typical accessories, such as the air conditioner must become electrically driven, so that if the engine of a hybrid shuts off, or if the vehicle does not have an engine, the passenger compartment can be kept comfortable.

One of the many challenges posed by electric compressors, is the task of fitting the compressor complete with an electric motor in a package that is the same as a typical belt driven accessory. Failure to accomplish this, results in a power train or vehicle architecture that has to be redesigned, which adds significant cost and complexity to the design. This is best avoided.

A second challenge posed by electric compressors is that Noise Vibration Harshness (NVH) characteristics must be much better than conventional engine driven accessories. Typically, the engine noise of a vehicle will drown out compressor noise. Since the compressor in hybrid and electric vehicles runs without engine operation, there is little or no engine noise to mask the sound of the compressor noise. It is therefore preferable to find another solution that will mask or prevent the compressor noise-noise that would otherwise be a nuisance to a passenger in the vehicle.

In conventional hybrid and electric vehicles, electric compressors are typically used to accomplish cooling of the passenger compartment. Since the package size of the compressor must be small, to fit the vehicle, compressors are typically equipped with a brushless DC motor, which drives the compressor. The brushless motor has an inverter, which converts the DC current from the battery to AC current that drives the rotating motor. Fitting the motor, inverter and compressor into a package that is the same as a belt driven compressor is very difficult. Hence, most electric compressors used on vehicles are larger than a belt driven version. As a consequence, the engine or vehicle layout must be altered, which adds significant cost and complexity to the vehicle. Additionally, typical electric compressors for vehicles tend to be noisy. To remedy this, the compressors are sometimes outfitted with additional shielding or noise blankets, which add complexity and cost.

As previously discussed, an electric compressor 5 typically includes a tube or cup shaped housing 10 that has the motor and compressor mechanisms stacked inside. This method of construction is shown in FIG. 1. In this figure, the compressor mechanism is supported via a ledge 15*a*, 15*b* in the cup shaped housing 10. The compressor mechanism generates vibration while it is in motion. Due to the fact that the compressor and housing are not rigidly connected, the vibration increases, since the rigidity of the compressor support is not large. As a consequence, NVH increases. Additionally, the large cup shaped housing is prone to flexure, which makes vibration generated by the compressor increase due to the bell like nature 20 of the housing as shown in FIG. 2. As illustrated in FIG. 2, the bell like nature of the housing 20 does not rigidly support the compressor, which causes large deflections at 22. Additionally, the cantilevered portion of the bell shaped housing is long, which further reduces rigidity.

SUMMARY OF THE INVENTION

The invention relates to a system and method of providing a compact structure for an electric motor. More specifically, the system and method provides a compact structure for placement of an electric motor in the body of a vehicle. Constructed in this manner, the system and method provide a compact structure for an electric compressor with the ability to reduce noise vibration harshness.

In one embodiment of the invention, there is a compressor mechanism having a front housing, center housing and rear housing. The center housing includes an integrated compressor bearing support and compressor base surface that divides the housing into cantilevered wall sections. The system and method constructed in this manner provides a compact structure for an electric compressor with the ability to reduce noise vibration harshness.

In one aspect of the invention, the compressor mechanism includes an electric motor cavity and a compressor cavity, wherein the electric motor cavity is larger in diameter than the compressor cavity.

In another aspect of the invention, the compressor mechanism includes a central support structure, wherein caps on the front and rear housings are secured to the center housing.

In still another aspect of the invention, the center housing and the integral compressor support each have a corresponding face machined to a specified tolerance affected by each face to ensure optimal alignment of each compressor mechanism component.

In yet another aspect of the invention, the front housing and center housing, each including a shaft supporting bearing and an interface, which allows a press fit between the front housing and center housing to assist in bearing alignment.

In another embodiment of the invention, there is a compressor mechanism, including a center housing with an integral central compressor support structure, wherein the central support structure includes an integral tight fitting annular gap to a drive shaft, positioned between a compressor portion and motor portion, which has a pressure differential across it.

In still another embodiment of the invention, there is a center housing including an integral central compressor support structure, the central support structure includes a shaft seal that maintains a pressure differential between a compressor and motor portion, wherein the shaft seal being is held radially in place by the center housing and axially in place between the housing and a bearing.

In one aspect of the invention, the bearing restraining the shaft seal is further secured in place via a staking operation.

In yet another aspect of the invention, there is a center housing including an integral central compressor support structure, the central support structure includes a shaft seal that maintains a pressure differential between the compressor and motor portion, wherein the shaft seal is held radially in place by the center housing and axially in place via a supporting surface ledge on the center housing and a staking operation.

In one aspect of the invention, the compressor mechanism includes another housing configured to receive a noise vibration harshness reducing member placed inside a motor side of the compressor mechanism.

In another aspect of the invention, the front and rear housings are clamped together with a single set of fasteners.

In still another aspect of the invention, the fasteners are threaded into the front housing.

In yet another aspect of the invention, the fasteners are threaded into the rear housing.

In another aspect of the invention, the bearing support includes a back pressure chamber which supports an orbiting scroll.

In yet another aspect of the invention, the rear housing includes a discharge pulsation deflecting mechanism to force the discharged fluid to expand into a maximum volume in the rear housing.

In still another embodiment of the invention, the discharge pulsation deflecting mechanism is horseshoe shaped.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
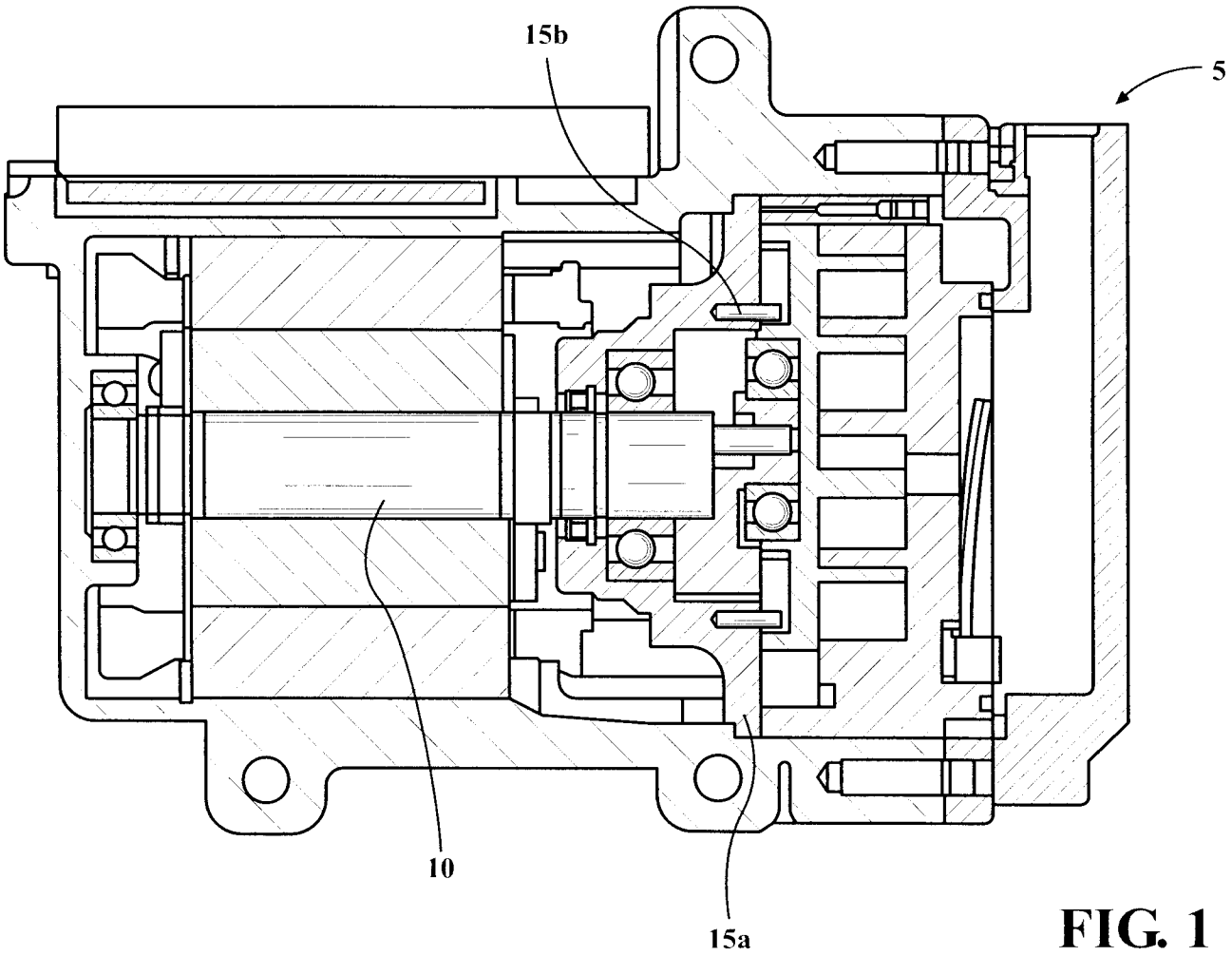
FIG. 1 PRIOR ART
FIG. 1 shows a compressor structure with a tube shaped housing according to the prior art.
Figure 2:
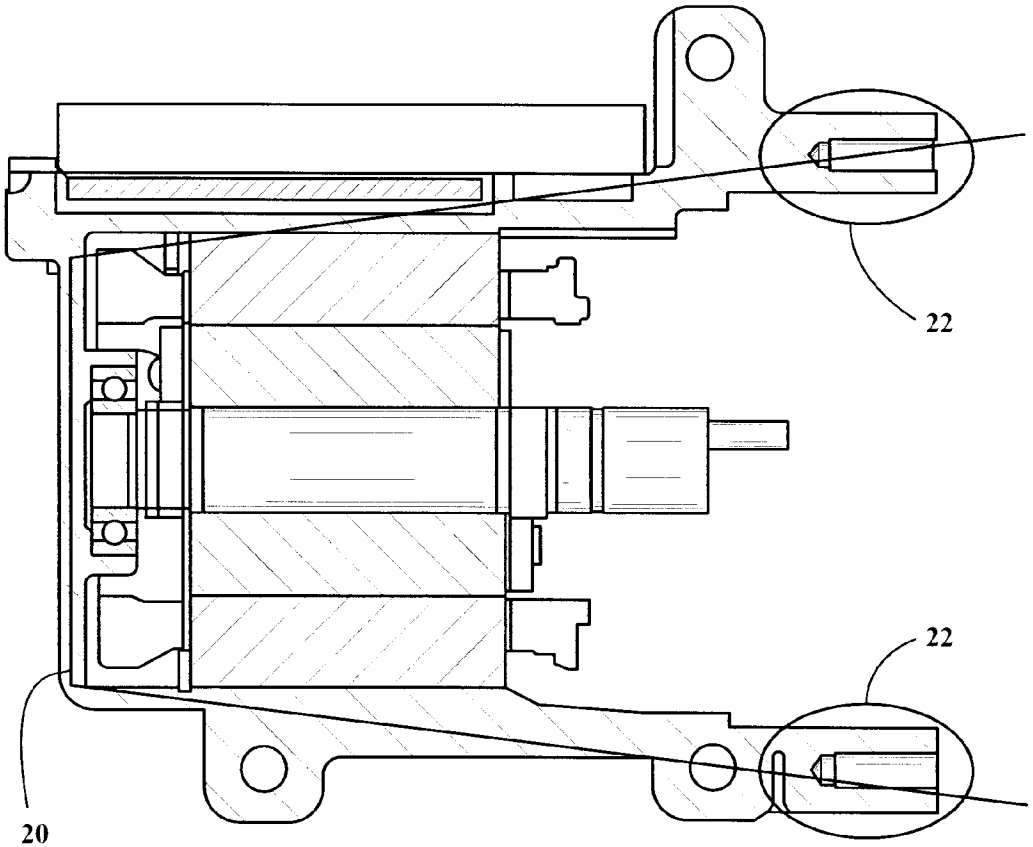
FIG. 2 PRIOR ART
FIG. 2 shows a compressor structure with a bell shaped housing according to the prior art.

A system and method of providing an electrically powered compressor assembly 25 having a one piece housing 26 with a pair of end sections 27*a*, 27*b* and a middle section 28 disposed axially between the end sections 27*a*~27*b*. The middle section 28 has a greater wall thickness than the end sections 27*a*, 27*b* and includes an integrated compressor bearing support and compressor base surface that divides the housing 26 into cantilevered wall sections. Each of the end sections 27*a*, 27*b* presents an open cavity, and the middle section 28 presents a passage extending between the open cavities. A compressor pump 34 is disposed within one of the open cavities and an alternating current motor 29 is disposed within the other open cavity. A shaft 31 is operably coupled to the compressor pump 34 and the electric motor 29 through the passage to power the compressor pump 34. A bearing 32 is disposed in the passage of the middle section 28 and supports the shaft 31. The exemplary compressor assembly 25 additionally includes a pair of end caps 33*a*, 33*b* coupled to the housing 26 and closing the open cavities. Adjacent the cavity with the electric motor 29 is a direct current to alternating current inverter 36 electrically connected to the electric motor 29 for converting direct current from a battery (not shown) into alternating current. The system and method constructed in this manner provides a compact structure for an electric compressor with the ability to reduce noise vibration harshness.

The electric compressor assembly 25 has a similar size as a conventional belt driven compressor and with superior NVH characteristics. Key characteristics of such a design include, but are not limited to: 1) a one-piece housing 26 design with a formed frame near the center; 2) ultra rigid housings; 3) a compact thrust support member for the compressor; 4) precision bearing alignment; and 5) an inline inverter that does not deviate from the general cylindrical shape of the compressor.

Figure 3:
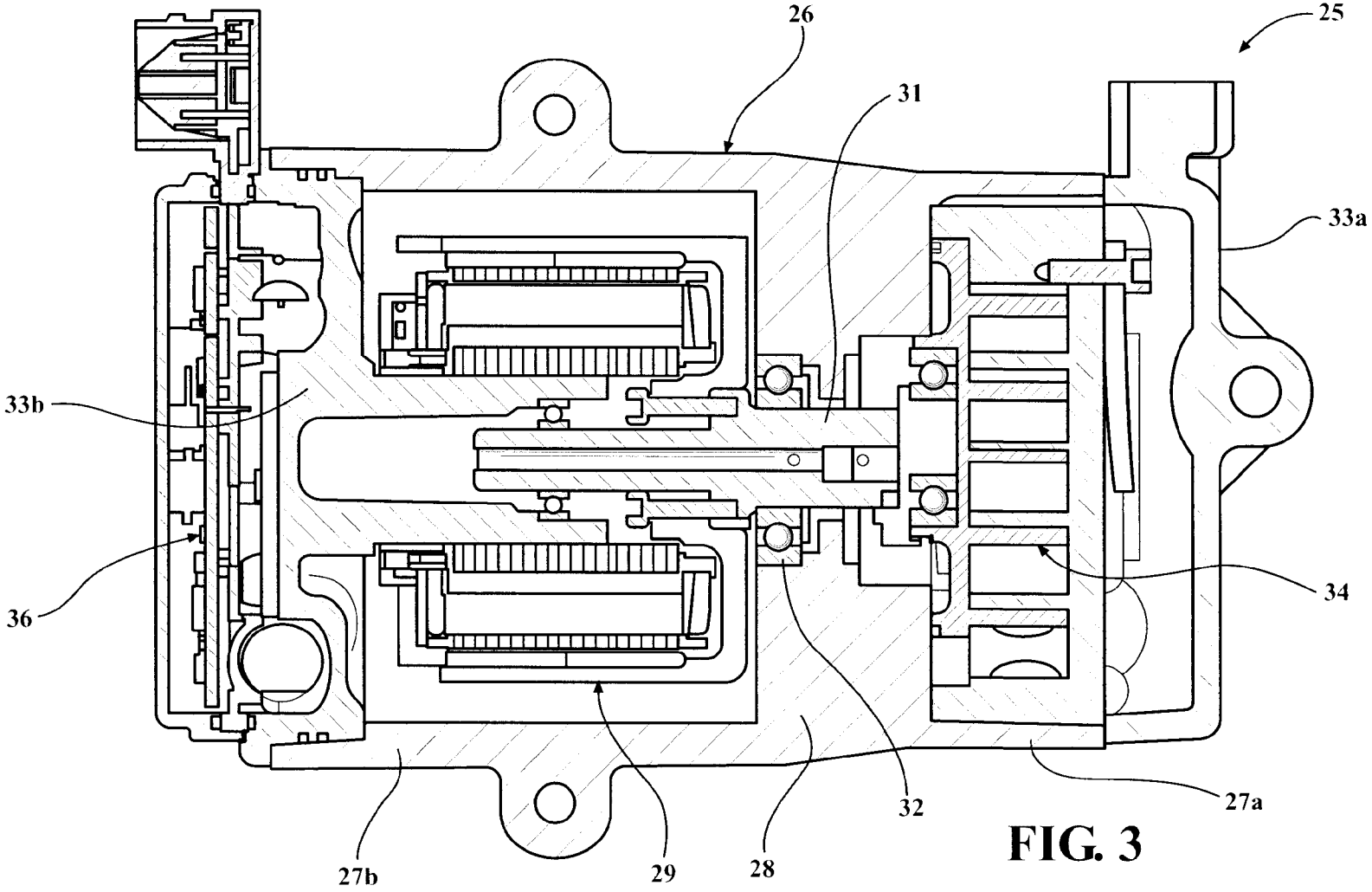
FIG. 3 shows a compressor structure in accordance with one embodiment of the invention.

FIG. 3 shows an exemplary design of a compressor assembly 25 in accordance with the characteristics described above. The electrically powered compressor assembly 25 is both compact and exhibits excellent NVH results because it has a reduced total number of parts as compared to other known compressor assemblies. In contrast, each part of the other known compressor assemblies must have a sufficient thickness to handle the loads of ordinary use and maintain proper rigidity. As these parts are added together, the total size of the assembly increases with each part. As the assembly becomes larger, the total rigidity decreases. Additionally, since no two parts can be perfectly machined, each additional part in the stack contributes to greater misalignment. All these characteristics lead to designs typically seen on current vehicles that are both large and not stiff, which is detrimental to package and NVH respectively.

The structure of the exemplary electric compressor assembly 25 accomplishes the task of both a compact design with acceptable NVH. This is made possible by combining what are typically separate parts and forming them as a single contiguous entity, to the extent possible. This leads overall, to a design that is: 1) More compact, since combined structural flanges are reduced, decreasing the total length; 2) Additional rigidity from a lack of interfaces that typically cause relative movement of one part to another; and 3) Greater alignment of parts, due to reduced number of stack interfaces and the ability to machine critical tolerance areas on adjacent pieces in a single work holding setup, since what were multiple pieces now constitute one entity. All the aforementioned characteristics collectively lead to compact and low NVH characteristics as well.

To greatly improve the rigidity of the compressor, cantilevered sections are minimized, or altogether removed. To eliminate this undesirable characteristic in a compressor, a compressor support structure and housing are used. The solution to these problems is to reduce the cantilevered portion and to rigidly attach the compressor to the housing. This is shown in FIG. 4.

Figure 4:
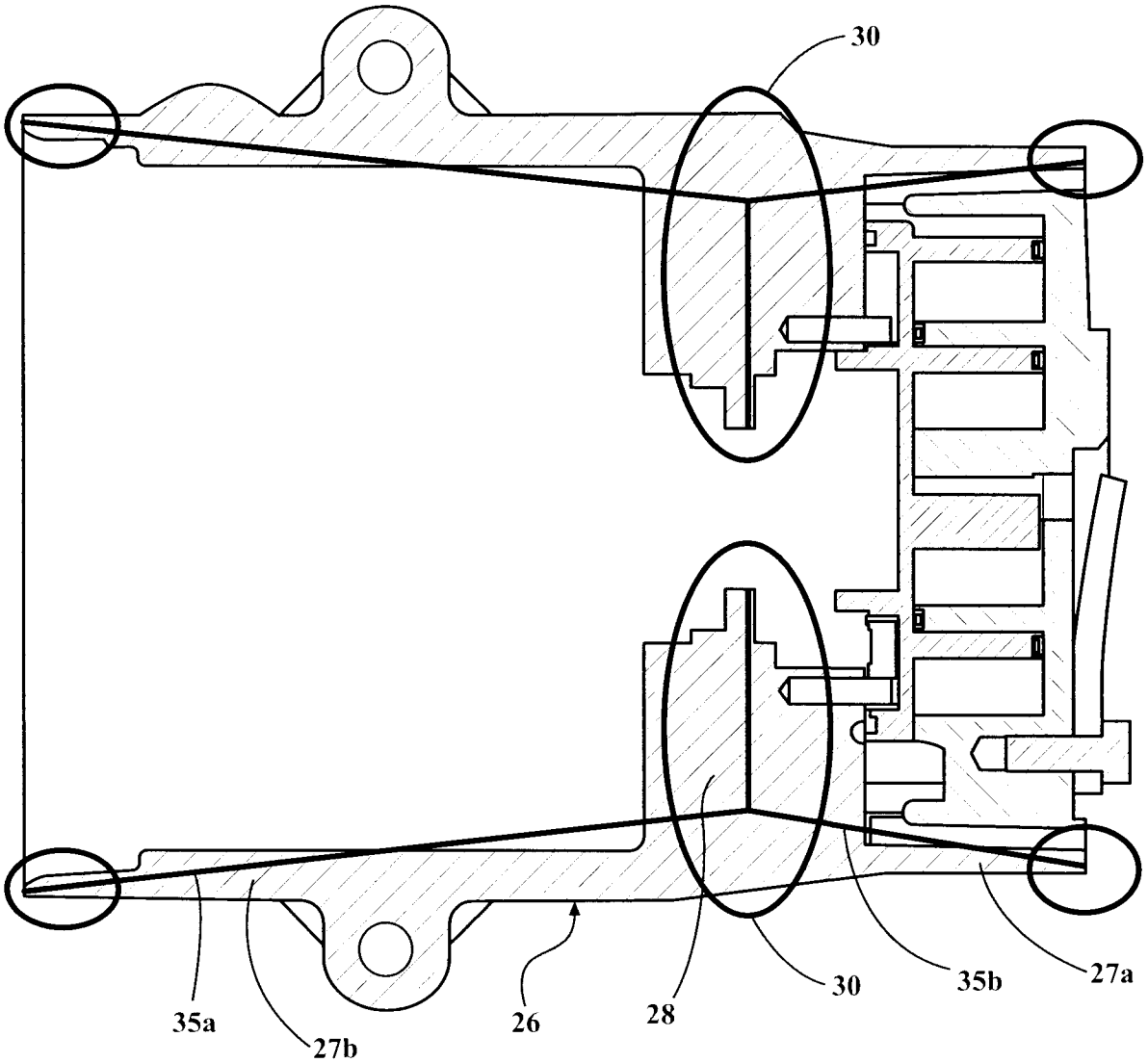
FIG. 4 shows a compressor structure in accordance with another embodiment of the invention.

Referring to FIG. 4, several benefits occur when a central bearing support 30 is integrated into the compressor housing 26. First, the cantilevered portion is now split into two areas 35*a* and 35*b*, with each having a shorter length than either known compressor assemblies. This greatly reduces the deflection of the casting at each of the four corners during use. Second, by integrating the bearing support of the compressor support into the compressor housing, the compressor becomes more rigid with improved NVH results. Lastly, the integration of the two parts also helps to reduce the overall length of the compressor, since there is no longer a duplication of supporting members, unlike the use of two separate parts in the prior art.

Figure 5:
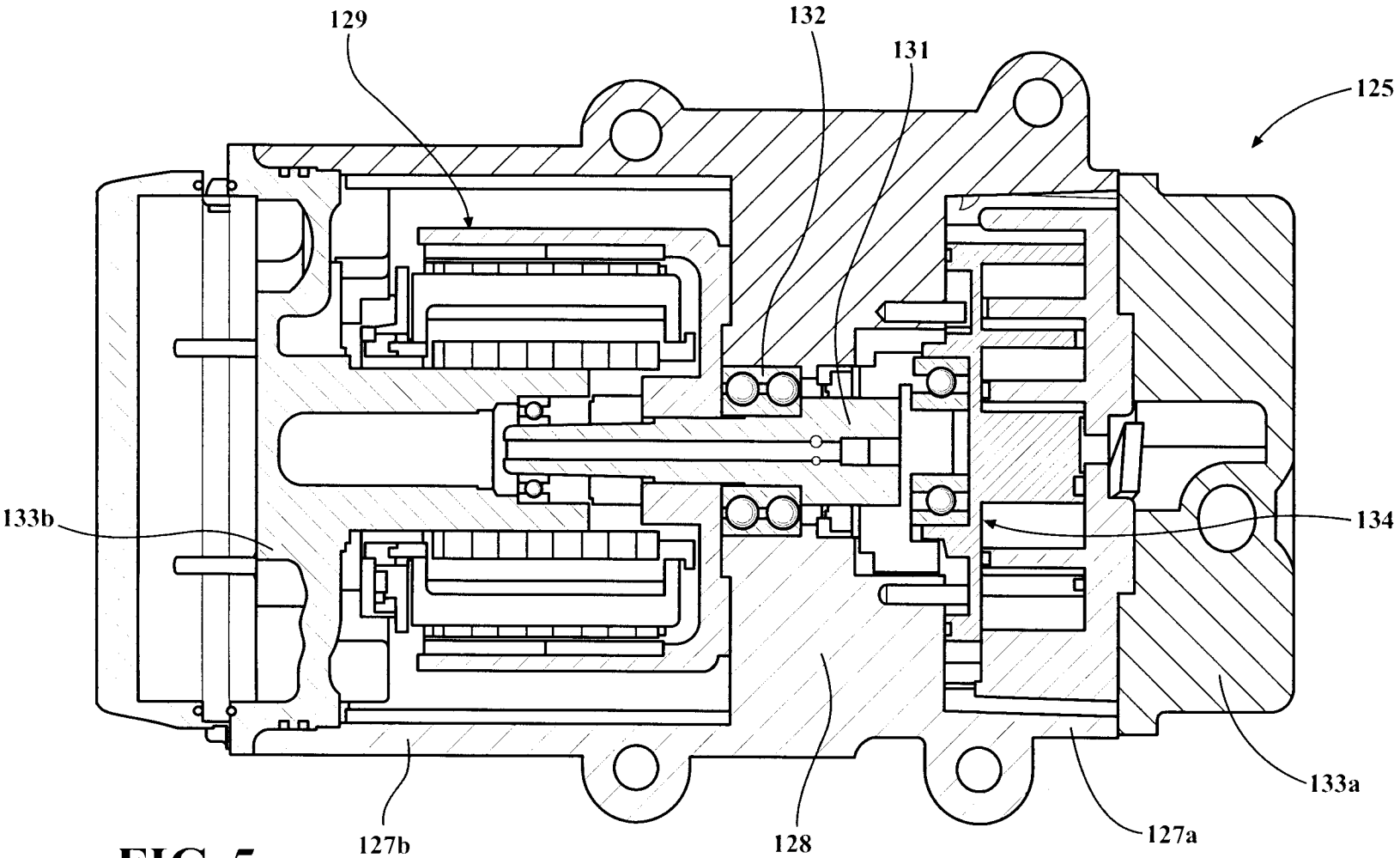
FIG. 5 shows a compressor structure in accordance with still another embodiment of the invention.

The compressor NVH can also be improved, if the stiffness is further improved, or the material characteristics are altered. A simple, yet effective addition to the aforementioned compressor design is the addition of stiffening rings or sleeves added to the housing 26. These members include a separate piece that is fitted into the housing 26. The members could be made from steel, or any material that would readily reduce the NVH. Another exemplary embodiment of an exemplary electrically powered compressor assembly 125 is generally shown in FIG. 5 wherein the same reference numerals, offset by a factor of 100, are used to identify similar features as discussed above.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. An electrically powered compressor assembly, comprising:

a one-piece housing presenting a pair of end sections and a middle section disposed axially between said end sections;

said end sections each presenting an open cavity;

said middle section presenting a passage extending between said open cavities of said end sections and being narrower than said open cavities of said end sections;

a compressor pump entirely within said open cavity of one of said end sections and an electric motor disposed entirely within said open cavity of the other of said end sections, including a stator and a rotor, the rotor surrounding the stator;

a shaft extending through said passage of said middle section and operably connecting said electric motor and said compressor pump;

said middle section of said one-piece housing having a greater wall thickness than said end sections such that said end sections extend axially away from said thicker middle section as oppositely facing cantilevered wall sections;

further including a bearing disposed entirely in said middle section of said one-piece housing and operably coupled to said shaft;

a central bearing support integrally provided with the one-piece housing; and a front housing engaged to said open cavity of the other of said end sections and including an extended part into which a part of the shaft is inserted, said extended part extends into the electric motor.

2. The electrically powered compressor assembly of claim 1, wherein said open cavity containing said electric motor is larger in diameter than said open cavity containing said compressor pump.

3. The electrically powered compressor assembly of claim 2, further including caps secured to said end sections of said housing to partially secure said electric motor and said compressor pump within said one-piece housing.

4. The electrically powered compressor assembly as set forth in claim 1 wherein said electric motor is an alternating current driven motor and further including a direct current to alternating current inverter coupled to said end section of said one-piece housing containing said electric motor and electrically connected to said electric motor.

* * * * *